United States Patent [19]

Wornall

[11] 3,930,285

[45] Jan. 6, 1976

[54] APPARATUS AND METHOD FOR FORMING STAPLE FIBERS AND FEEDING THE SAME TO A PICKER

[75] Inventor: William D. Wornall, Linville, N.C.

[73] Assignees: Alfred Proctor Aldrich, Jr., Atlanta, Ga.; Aldrich Machine Works, Greenwood; Lummus Industries, Inc., Columbus, both of S.C.

[22] Filed: Oct. 24, 1973

[21] Appl. No.: 409,054

[52] U.S. Cl. ..... 19/.56; 19/65 A; 19/97.5; 19/105

[51] Int. Cl.[2] ..... D01G 1/04; D01G 9/16

[58] Field of Search ..... 19/.25, .32, .56, 65 R, 19/65 A, 105, .35, 243, .58, .6, .3, .46, .51, 97.5

[56] References Cited

UNITED STATES PATENTS

| | | | |
|---|---|---|---|
| 1,709,646 | 4/1929 | Woodward | 19/.25 |
| 1,814,129 | 7/1931 | Curley | 19/65 A |
| 1,875,356 | 9/1932 | Shaw | 19/65 A |
| 2,057,641 | 10/1936 | Curley et al. | 19/.25 X |
| 2,155,598 | 4/1939 | Holt et al. | 19/65 A |
| 2,186,135 | 1/1940 | Childs | 19/.32 X |
| 2,822,582 | 2/1958 | Hayward et al. | 19/65 T |
| 3,017,684 | 1/1962 | Pittman | 19/.32 X |
| 3,087,203 | 4/1963 | Pearson | 19/.56 X |
| 3,157,440 | 11/1964 | Hijiya et al. | 19/65 R X |
| 3,503,100 | 3/1970 | Glynn et al. | 19/.56 X |

FOREIGN PATENTS OR APPLICATIONS

| | | | |
|---|---|---|---|
| 1,091,080 | 11/1967 | United Kingdom | 19/65 R |
| 1,009,774 | 3/1952 | France | 19/10 S |

*Primary Examiner*—Dorsey Newton
*Attorney, Agent, or Firm*—Parrott, Bell, Seltzer, Park & Gibson

[57] ABSTRACT

An apparatus and method wherein a tow of continuous filaments is fed to a tow cutter and severed into fibrous material of predetermined staple length while the fibrous material delivered from the tow cutter is fed to and through at least one textile picker. The fibrous material may be formed into laps at the picker for being subsequently processed through cards, or the fibrous material may be fed in loose fibrous form from the picker to a bank of cards. Means are provided for automatically controlling operation of the tow cutter and pickers and for controlling feeding of the fibrous material to the pickers.

21 Claims, 14 Drawing Figures

10'
20'
30'
31'
32'
40'
41'
42'
44'
45'
48'
49'
50'
51'
52'
53'
54'
56'
54a
101
102
103
104
105
106
107
108
109
120
121
122
T'

APPARATUS AND METHOD FOR FORMING STAPLE FIBERS AND FEEDING THE SAME TO A PICKER

This invention relates to a method and apparatus for processing textile fibers, and more particularly to a method and apparatus for producing staple fibrous material of predetermined staple length while feeding the same to a picker.

In accordance with the prior art, yarn manufacturers have conventionally obtained synthetic fiber material from a fiber producer in the form of staple which has been previously cut to a predetermined staple length from a tow of continuous filaments and thereafter packaged in bales. In producing yarns from this staple fibrous material, it is necessary for the yarn manufacturer to unbale the fibrous material, which is initially in compressed and compacted condition, and to feed the fibrous material to suitable opening and picking equipment to open the compacted masses of the fibrous material and facilitate further processing thereof. Although machines have been provided for removing fibrous material from bales, these machines are expensive and still require that at least a portion of the unbaling and feeding operation be performed manually.

When yarns of a similar type but requiring fibers of a different staple length are produced by a yarn manufacturer, it becomes necessary for the manufacturer to purchase and to maintain an inventory of the several different staple lengths. The problems and expense attendant with the maintenance of an adequate inventory of the fibrous material in the necessary staple lengths are readily apparent when it is understood that delays of as long as 6 weeks to 3 months are often encountered in obtaining fibrous material of a particular staple length from the fiber producer.

With the foregoing in mind, it is a primary object of the present invention to eliminate the need for manually unbaling and feeding the staple fibrous material to fiber processing equipment by providing an apparatus and method for converting continuous filament tow into staple fibrous material while feeding the fibrous material directly to a textile picker.

It is a further primary object of the invention to eliminate the necessity of maintaining an inventory of staple fibrous material in several different staple lengths by providing an apparatus and method of the type described wherein the continuous filament tow may be converted into staple fibrous material of any required staple length, as desired.

It is another object of the invention to facilitate obtaining a blend of fibrous material from different types of tow by providing an apparatus and method of the type described wherein the continuous filament tow being converted into staple fibrous material comprises a plurality of tows with at least one of the tows being formed of continuous filaments of a different characteristic from the continuous filaments of another one of the tows.

It has been found that the above objects may be accomplished in accordance with the present invention by providing an apparatus which includes a tow cutter for receiving continuous filament tow and for severing the same into fibrous material of predetermined staple length, a picker having a hopper for receiving the fibrous material from the tow cutter and also having evening means for obtaining a substantially uniform weight of delivery of the fibrous material processed therethrough, and means operatively connected to the tow cutter and to the hopper of the picker for feeding the fibrous material from the tow cutter to the picker. In accordance with the invention the picker may be equipped with means for forming the fibrous material into laps at the delivery end of the picker, or with means for feeding the fibrous material in loose fibrous form directly from the picker to a bank of cards.

Some of the objects and advantages of the invention having been stated, others will appear as the description proceeds, when taken in connection with the accompanying drawings, in which FIG. 1 is a block diagram illustrating the method steps in accordance with a first form of the invention;

Figures 3, 3A:
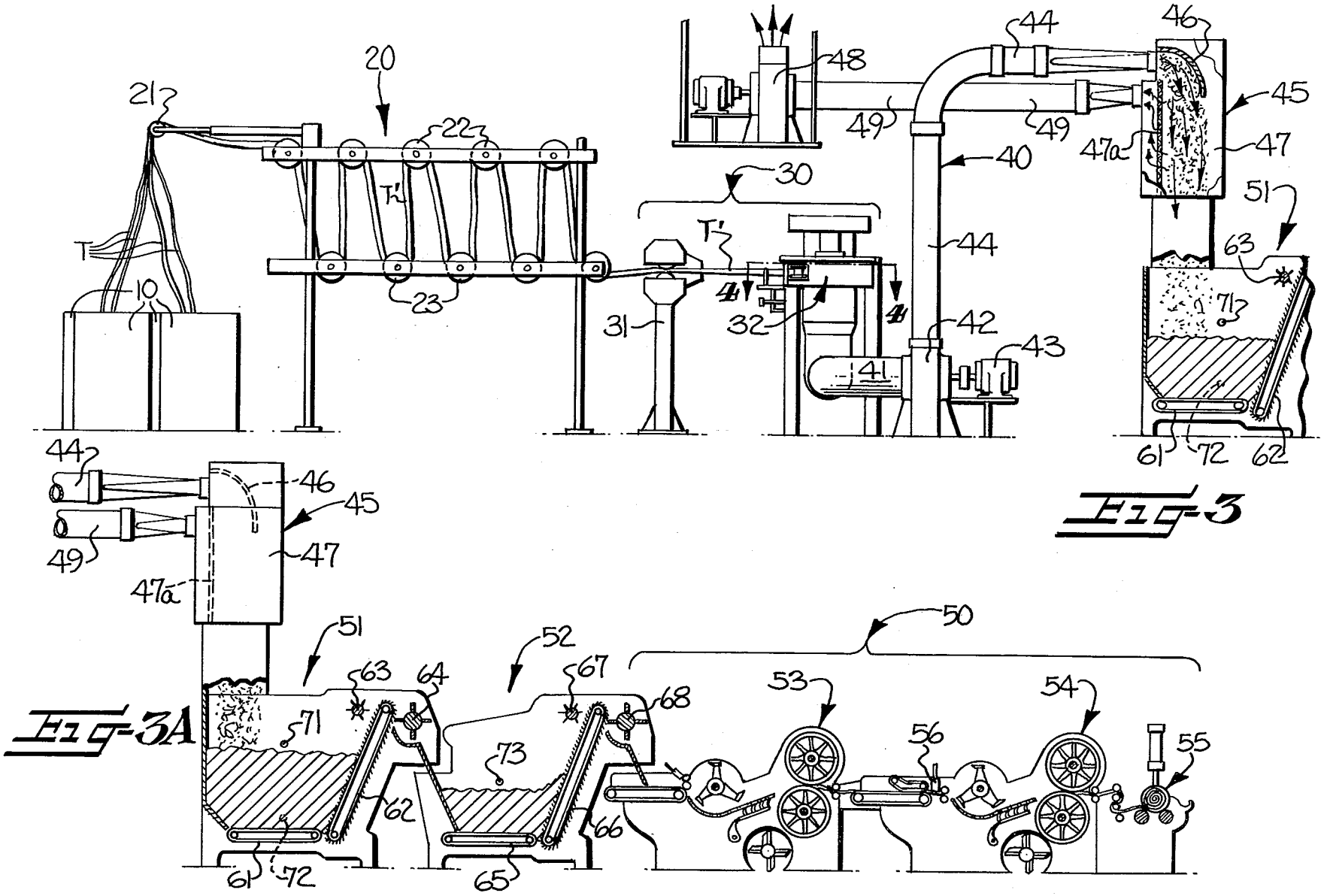
FIG. 3 is a schematic side view, partially in elevation and partially in section, of a portion of an apparatus in accordance with the first form of the invention.
Figure 4:
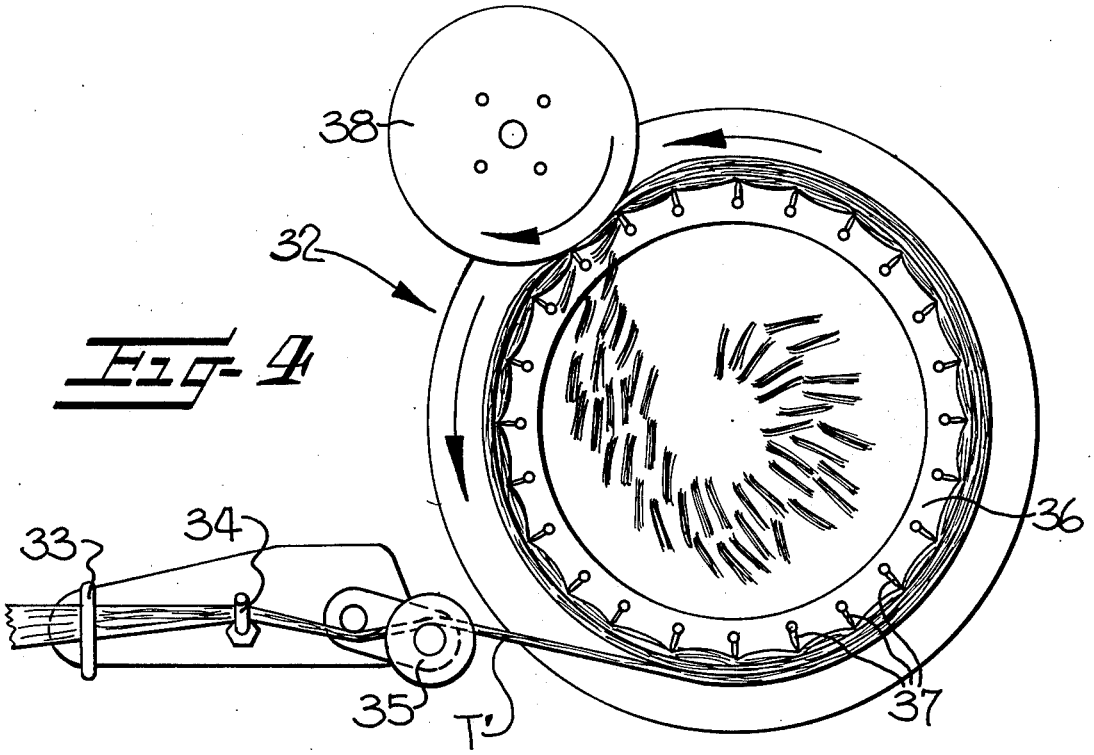
Figure 5:
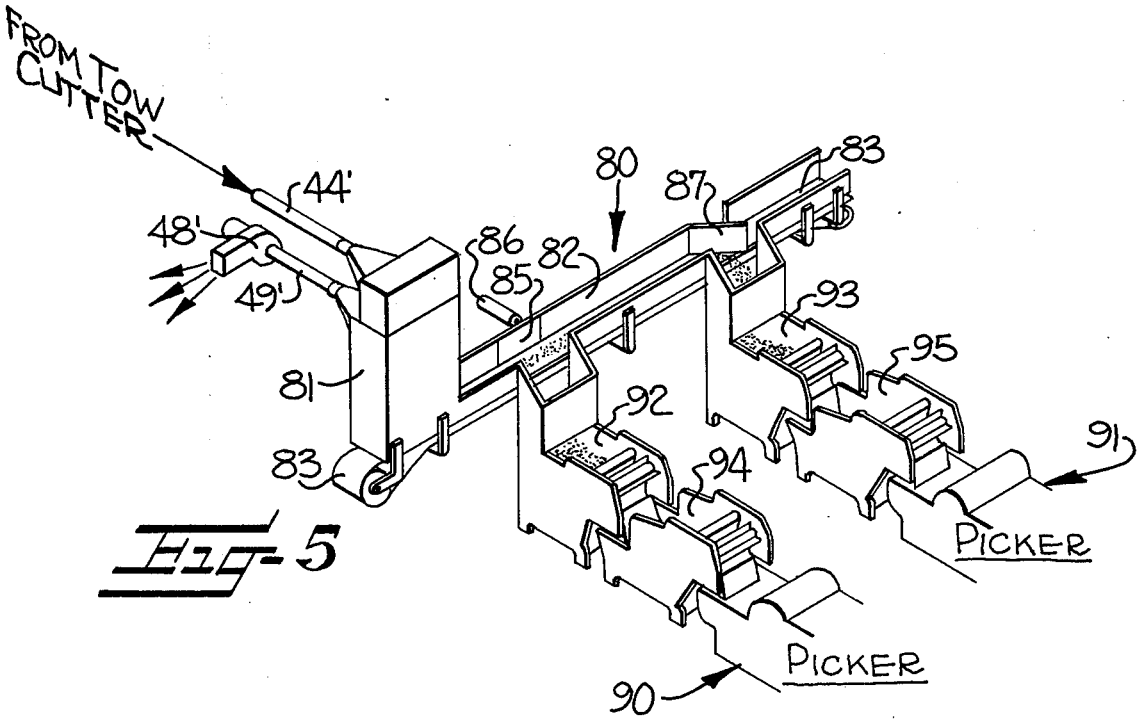
Figure 6:
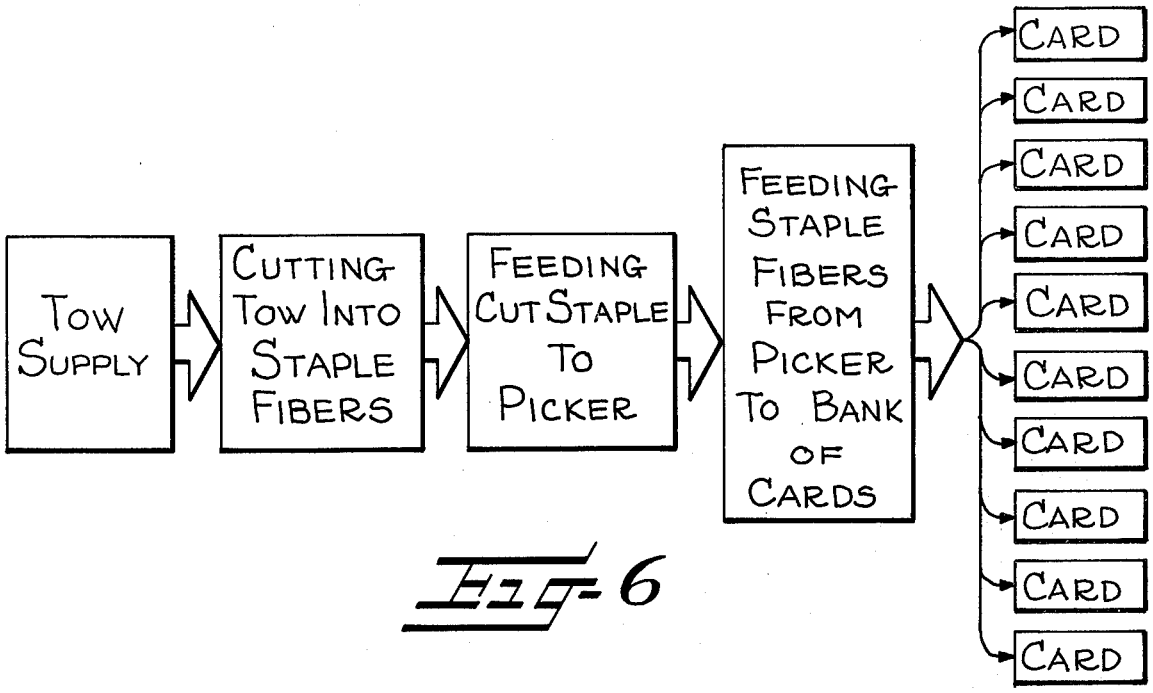
Figure 7:
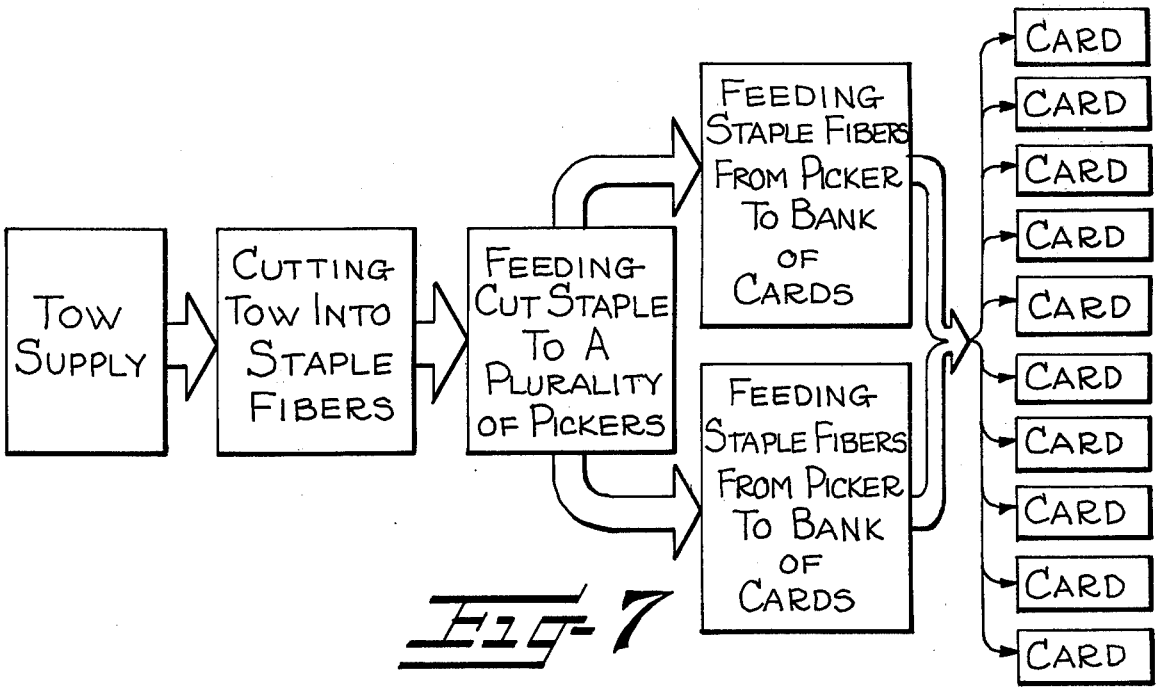
Figures 8, 9:
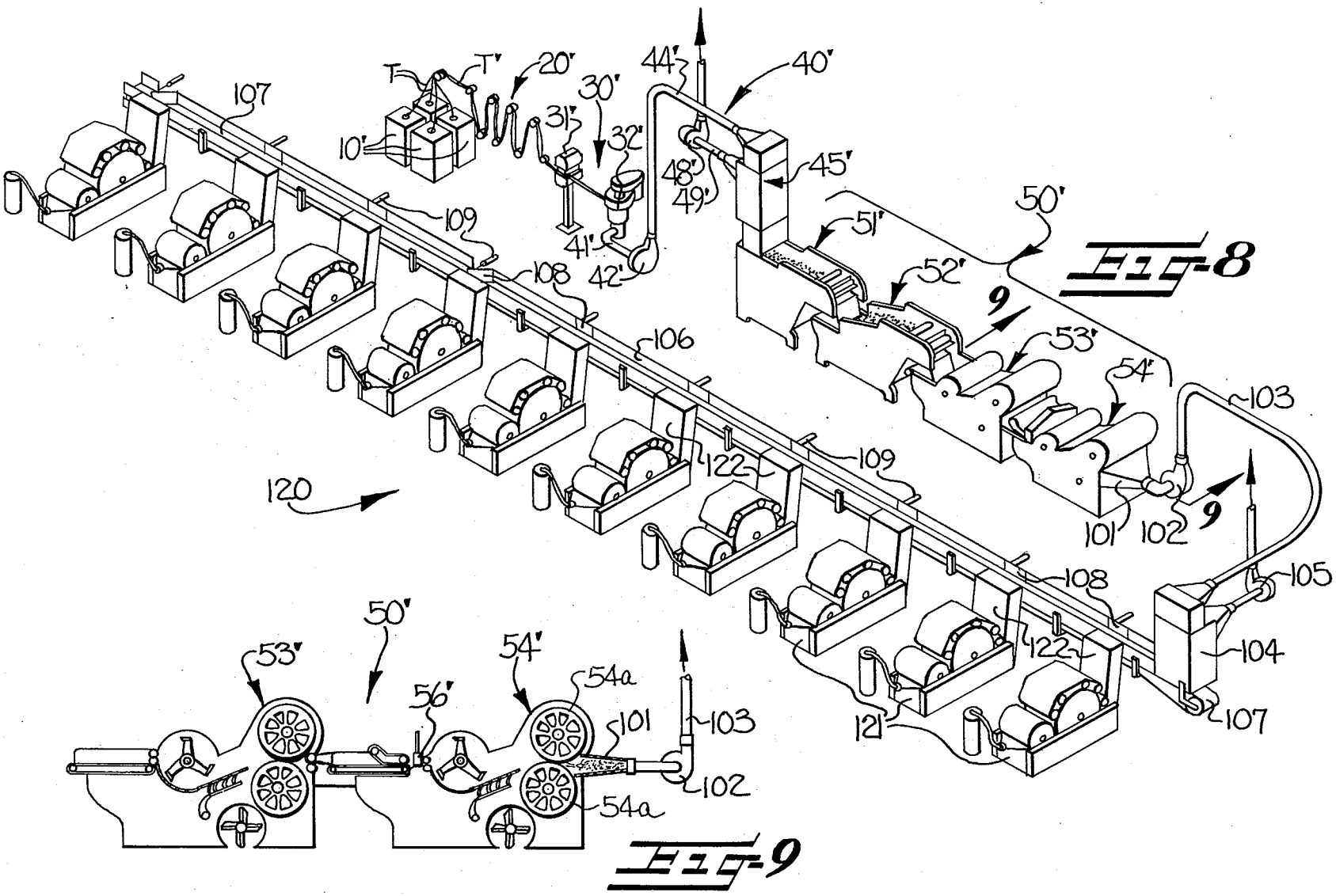
Figure 10:
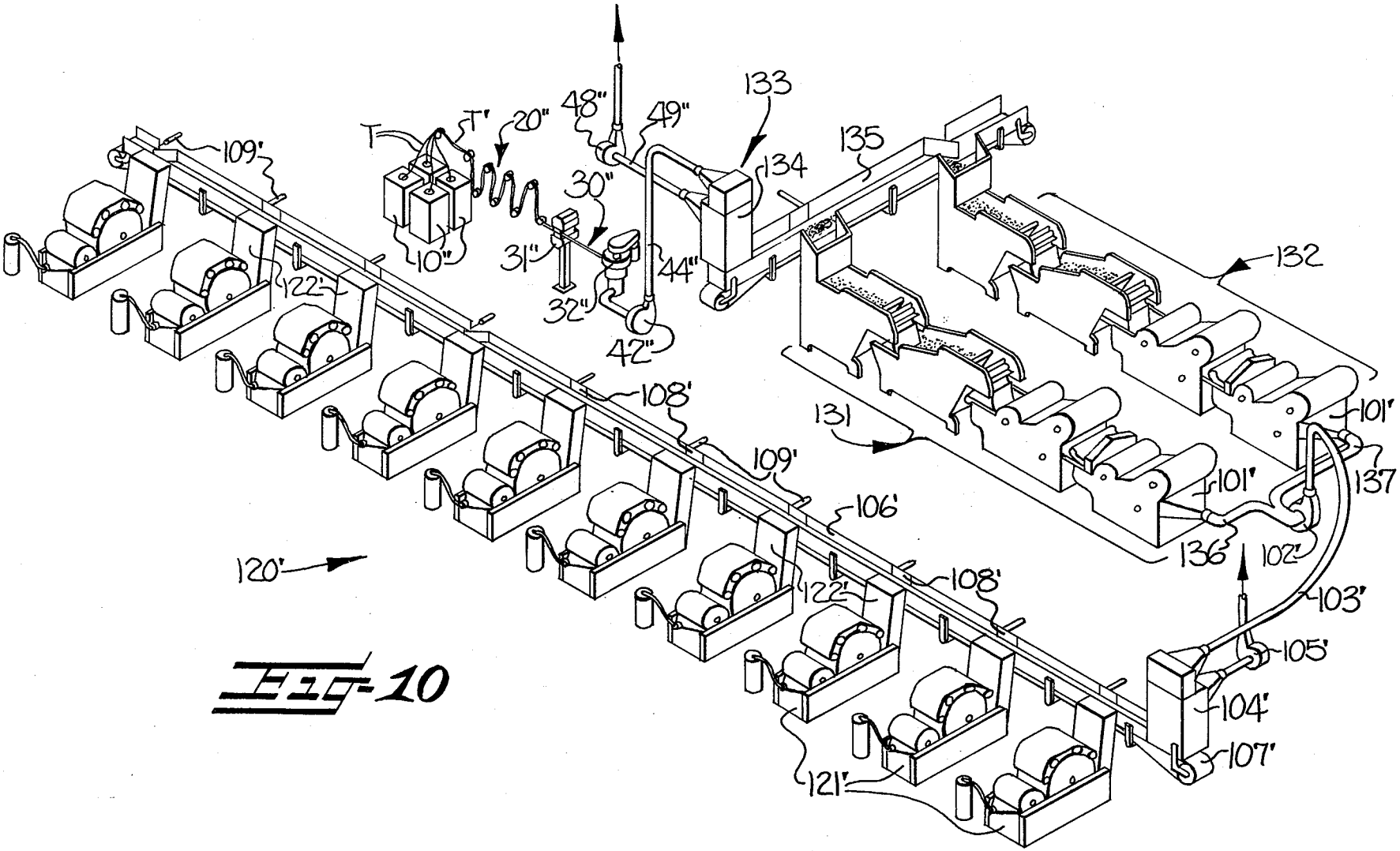
Figure 11:
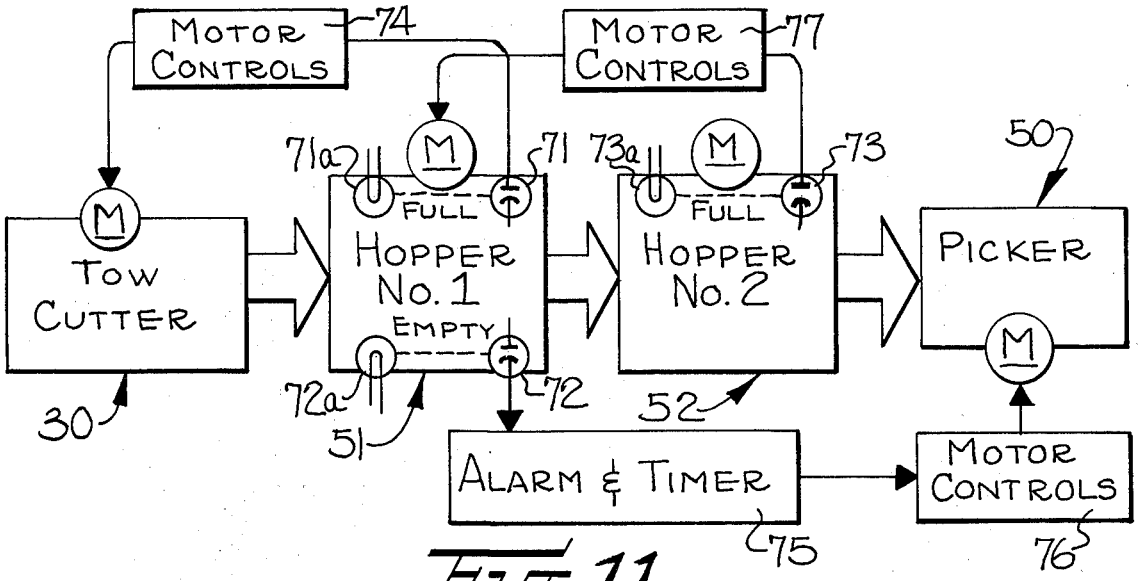
Figure 12:
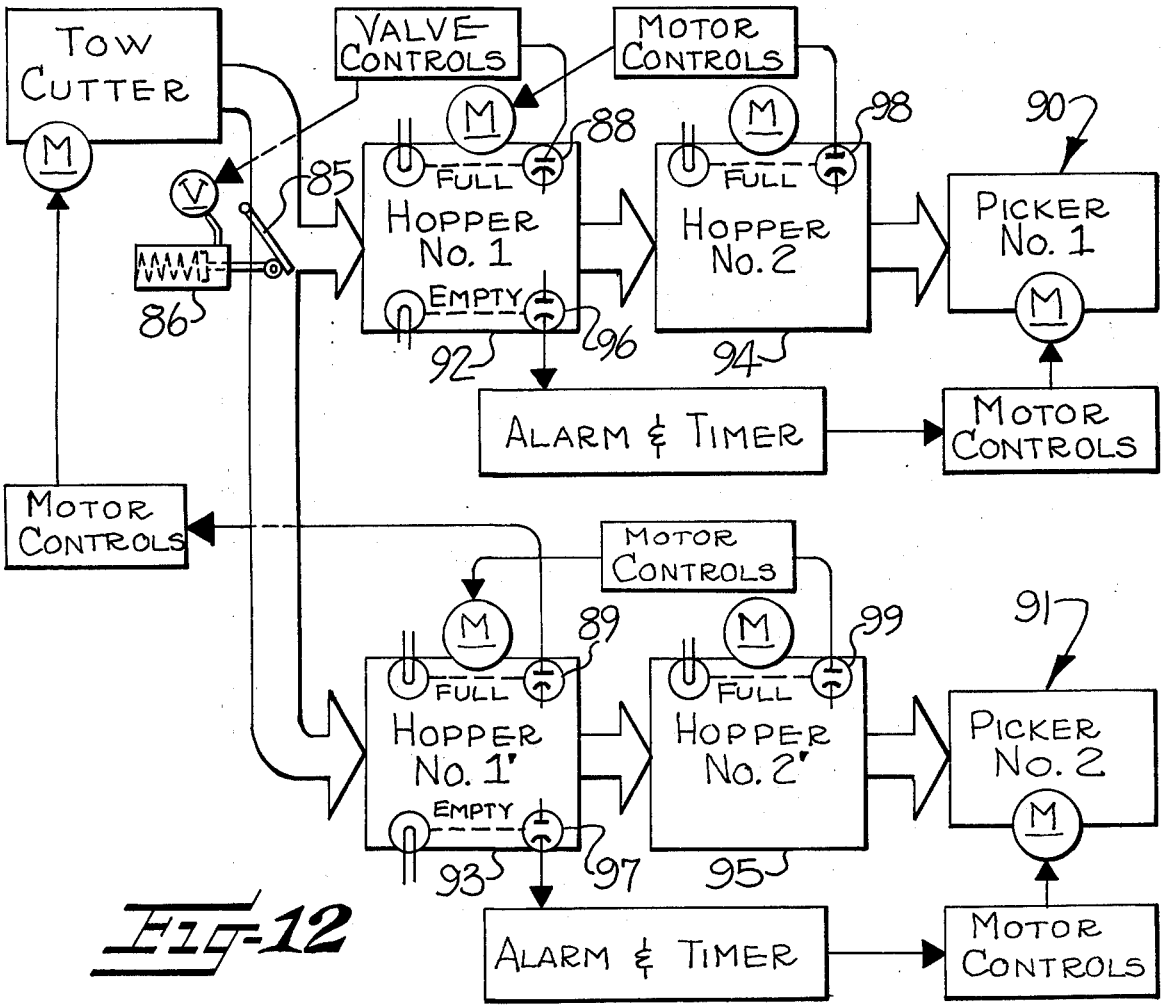
Figure 13:
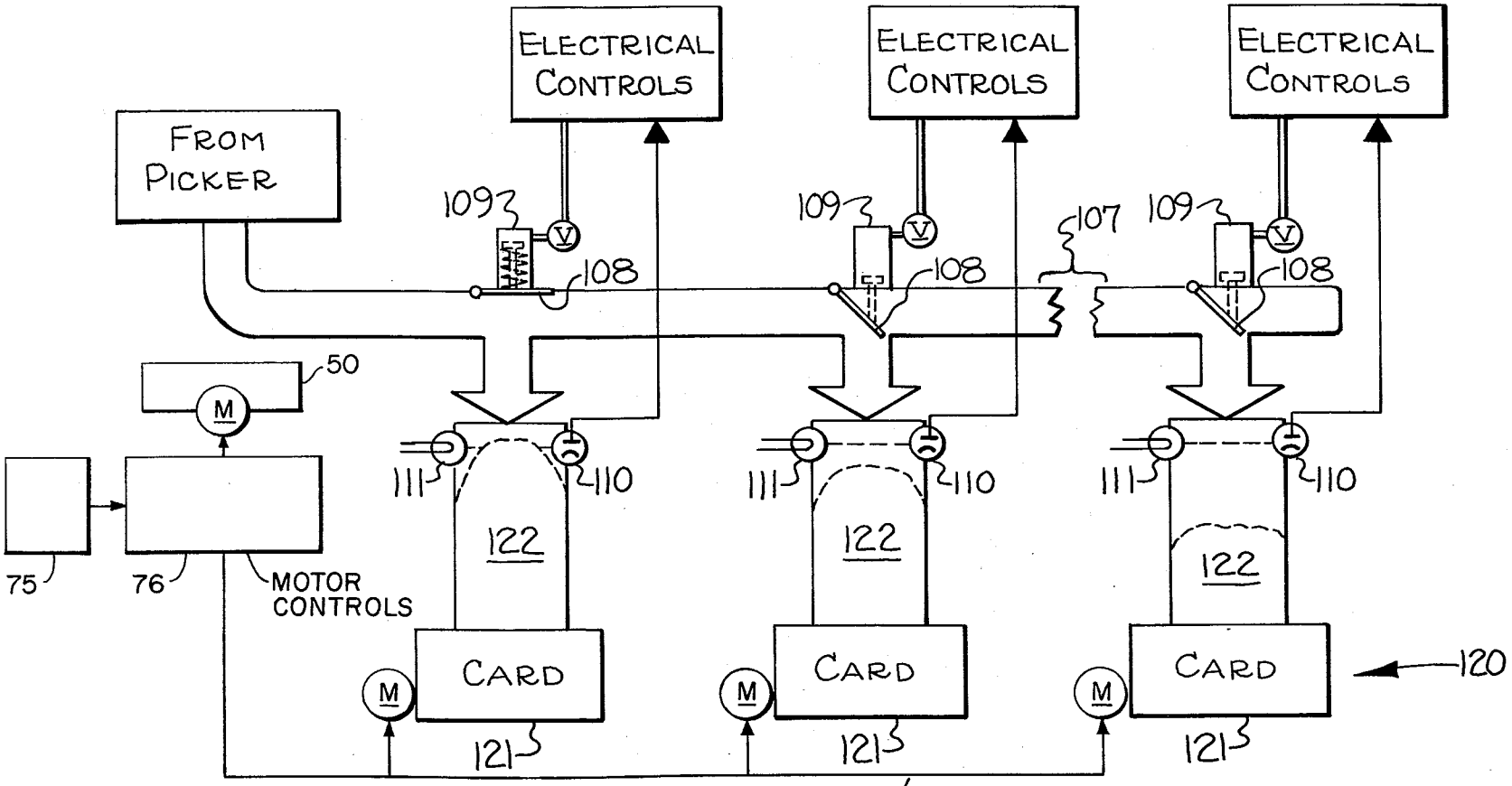

FIG. 3*a* is a schematic side view, partially in elevation and partially in section of the remaining portion of the apparatus of FIG. 3;

FIG. 4 is a sectional view through the tow cutter taken substantially along line 4—4 of FIG. 3;

FIG. 5 is a schematic perspective view of an apparatus for feeding the fibrous material from the tow cutter to two pickers in accordance with the second form of the invention;

FIG. 6 is a block diagram illustrating the method steps in accordance with a third form of the invention;

FIG. 7 is a block diagram illustrating the method steps in accordance with a fourth form of the invention;

FIG. 8 is a schematic perspective view of an apparatus in accordance with the third form of the invention;

FIG. 9 is a sectional view of the picker taken along line 9—9 of FIG. 8;

FIG. 10 is a schematic perspective view of an apparatus in accordance with the fourth form of the invention;

FIG. 11 is a block diagram illustrating the controls for controlling feeding of the fibrous material to a single picker;

FIG. 12 is a block diagram illustrating the controls for controlling feeding of the fibrous material to a pair of pickers; and FIG. 13 is a block diagram illustrating the controls for controlling feeding of the fibrous material from one or more pickers to a bank of cards.

Figure 1:
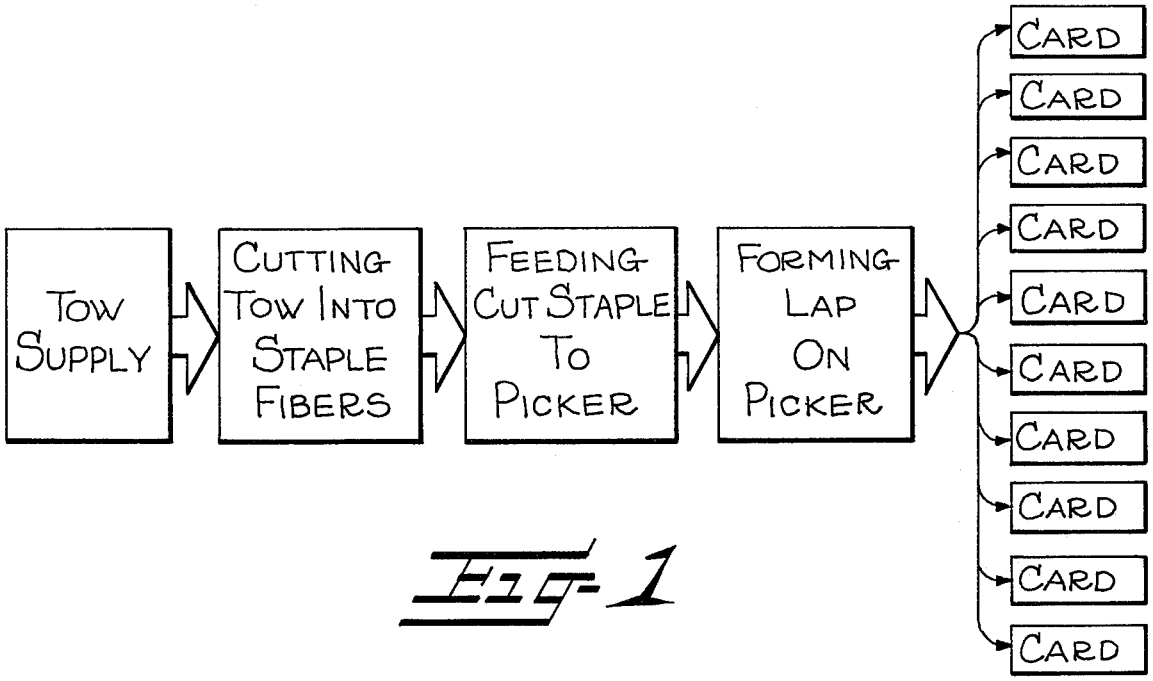

In accordance with a first form of the invention, and as illustrated in block form in FIG. 1, a tow of continuous filaments is fed from a suitable tow supply to a cutting device where it is cut into staple fibrous material of a predetermined staple length. As the staple fibrous material is formed at the cutting device, it is removed therefrom and fed to and through a picker. At the delivery end of the picker the fibrous material is formed into conventional laps for being subsequently processed in a conventional manner through any of several cards.

Figure 2:
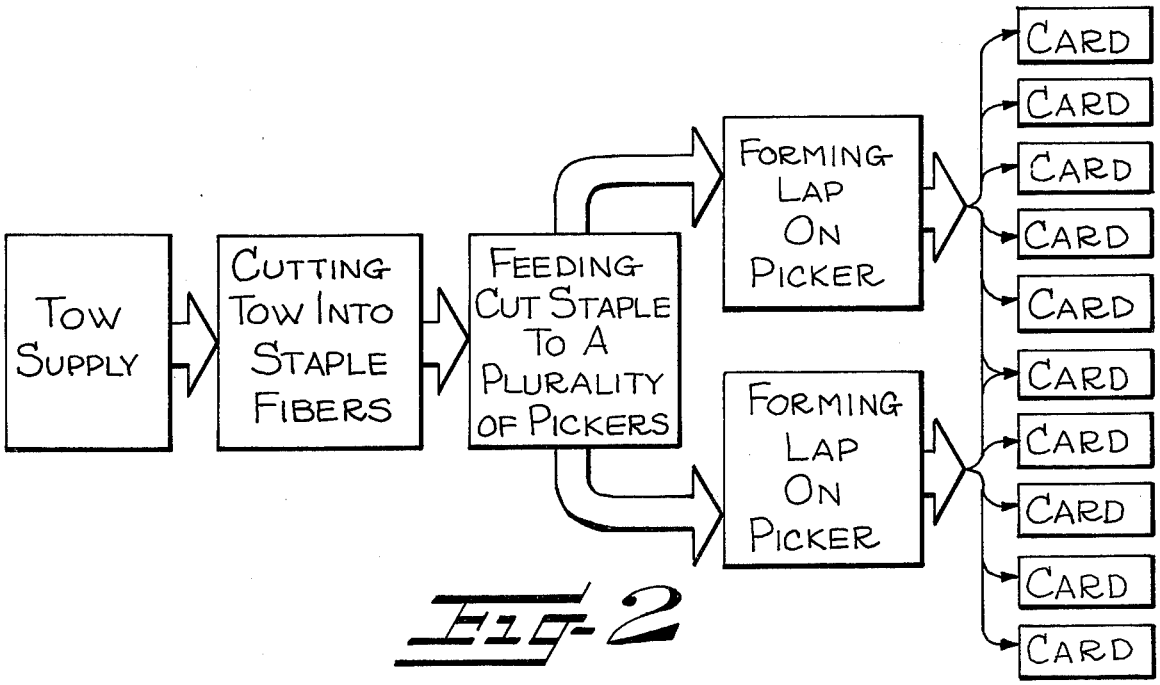
FIG. 2 is a block diagram illustrating the method steps in accordance with a second form of the invention.

Under some circumstances, it may be desirable to feed the fibrous material from the cutting device to more than one picker and to form laps in a conventional manner at the delivery end of each of the pickers with the laps subsequently being processed through any of several cards. This arrangement would be necessary, for example, where the total rate of production of the several cards exceeds that of a single picker. Thus, as illustrated in FIG. 2, the second form of the invention is quite similar to the first form and differs thereover only in that the staple fibrous material is fed from the cutting device to a plurality of pickers.

A suitable apparatus in accordance with the first form of the invention as described above is illustrated in FIGS. 3 and 3*a*, wherein reference character 10 indicates a plurality of containers or boxes of continuous filament tow and wherein the respective tows from each box are each indicated by the reference character *T*. A creel, broadly indicated at 20, is provided adjacent the tow containers and includes a pulley 21 positioned above the tow containers to facilitate removing the tows *T* from each container. As the respective tows *T* pass over pulley 21 they are combined to form a single relatively large composite tow *T'*. Creel 20 also includes a series of spaced upper pulleys 22 and lower pulleys 23 around which the tow *T'* is threaded in a sinusoidal or zig-zag manner. The purpose of pulleys 22, 23 is to facilitate combining the respective tows *T* into a single uniform composite tow *T'* of continuous filaments by removing folds, false twist, and entanglements from the respective tows *T* while also applying tension thereto.

The composite tow *T'*is thereafter fed from the creel 20 to a cutting device, broadly indicated at 30. The tow cutting device includes a revolving reel type tow cutter 32 and a tension stand 31 for uniformly pretensioning the tow *T'* while feeding the same to the tow cutter 32.

The operation of tow cutter 32 will be understood more fully by referring to FIG. 4 where it will be seen that the tow *T'* is passed around a series of tow guides 33, 34, 35 which serve to flatten the tow *T'* into a flat band. The band of tow is then wrapped about a revolving reel 36 equipped with a plurality of equally spaced radially outwardly directed cutting blades 37. A pressure roller 38 is positioned to one side of the revolving reel 36 and closely adjacent the cutting edges of the blades as they move past pressure roller 38 so that as the band of tow is wound about the reel and builds up between the blades and the pressure roller, the inner layer of the tow band is forced against the cutting edges of the blades 37, thus severing the tow into short lengths of staple fiber. The tow cutter 32 is adapted for cutting staple fibers of any desired staple length by merely adjusting the spacing between the cutting blades on the cutting reel. To facilitate quickly adapting tow cutter 32 for cutting tow into fibers of a different staple length, the revolving cutting reel 36 may be easily removed from tow cutter 32 and replaced by a similar reel having a different blade spacing.

This type of revolving reel cutter is disclosed in U.S. Pat. 3,485,120, issued Dec. 23, 1969; in U.S. Pat. No. 3,503,100, issued Mar. 31, 1970; and in U.S. Pat. No. 3,744,361, issued July 10, 1973, to which reference may be made for further details of the structure and operation of the tow cutter.

As the tow is cut in tow cutter 32, the staple fibrous material is removed from the tow cutter at the lower end thereof by means of a pneumatic conveyor system, broadly indicated at 40 (FIG. 3). Pneumatic conveyor system 40 includes a conduit 41 which receives the fibrous material from the discharge end of the tow cutter 32 and delivers the same to the inlet side of a material handling fan 42, which is driven by an electric motor 43. A relatively long conduit 44 is connected to the outlet side of material handling fan 42 and conveys the fibrous material to the inlet port of a condenser, broadly indicated at 45. As illustrated, condenser 45 is a stationary screen type condenser and is positioned over the feed hopper of a picker 50 so as to deliver the fibrous material from the tow cutter to the picker.

As the fibrous material is blown into condenser 45 through the fiber inlet port adjacent the upper end thereof, a baffle plate 46 deflects the fibrous material downwardly into a screen area 47. Screen area 47 comprises an elongate housing having open opposite ends and having at least one of the walls thereof formed of a foraminous screen material, indicated in FIG. 3 at 47*a*. A suction fan 48 is connected by a conduit 49 to a jacket surrounding the screen area 47 and exhausts the same amount of air from condenser 45 that material handling fan 42 blows into the condenser. Thus, a dead air space is created within the screen area 47 and the fibrous material falls freely from the fiber discharge at the lower end of the condenser without being compressed or matted.

Referring now to FIG. 3*a*, a single process textile picker is broadly indicated at 50 and includes a first feed hopper broadly indicated at 51, positioned beneath condenser 45 for receiving the fibrous material discharged therefrom, a second feed hopper broadly indicated at 52, positioned for receiving the fibrous material from the first feed hopper 51, two beater sections broadly indicated at 53 and 54, and a calender section broadly indicated at 55, at the delivery end of the picker for forming the fibrous material into laps. Since single process pickers such as that illustrated in FIG. 3*a* are generally well known to persons skilled in the textile arts, a detailed discussion will not be given here of all the elements of the picker. It is believed sufficient to merely point out that the picker is provided, as is conventional, with an evener motion 56 between the first and second beater sections 53, 54 for providing a uniform delivery of fibrous material from the picker. The structure and operation of such evener motions is well known to those skilled in the textile arts, and thus a detailed description of the evener motion 56 is not deemed necessary. For a detailed disclosure of one type of evener motion suitable for use in the picker illustrated herein, reference may be had to U.S. Pat. No. 3,680,192, granted Aug. 1, 1972.

Referring now more specifically to the feed hopper sections 51, 52 of the picker, it should be recognized that while two feed hopper sections are illustrated, a single feed hopper may be suitably employed, if desired. The reasion for providing two hoppers is to provide means for immediately feeding fibrous material into the second hopper 52 whenever the fibrous material therein drops below a desired level, thus facilitating maintaining the level of fibrous material in hopper 52 substantially uniform and thereby facilitating uniformity of operation of the picker.

Referring more specifically to the first hopper 51, the hopper is provided in a conventional manner with a bottom apron 61 and with a lifting apron 62. The lifting apron is provided with pins or spikes for engaging the fibrous material and lifting the same upwardly toward the outlet end of the hopper. A combing roll 63 near the upper end of the lifting apron prevents excessive amounts of fibrous material from being fed from the hopper and, together with lifting apron 62, also serves to further open the fibrous material to some extent. A doffer roll 64 on the opposite side of the lifting apron removes the fibrous material from the lifting apron and directs the same from the outlet of the first hopper into the second hopper 52. The second hopper 52 is of similar construction to hopper 51 and is also provided with a bottom apron 65, a lifting apron 66, and with combing and doffing rolls 67, 68.

High and low sensing elements 71, 72 are provided in the first hopper 51 for sensing when a predetermined high or low level of fibrous material is present in the hopper. These sensing elements are connected to suitable control circuitry, to be described later, for controlling operation of the tow cutter and the picker for maintaining a desired level of fibrous material in hopper 51 and for assuring uiiform operation of the picker. Also, a sensing element 73 is provided in the second hopper 52 for sensing when a predetermined high level of fibrous material is present in hopper 52 and for stopping the feed of fibrous material from the first hopper 51 when the desired level of fibrous material is present in hopper 52.

The circuitry and mechanism for controlling operation of the apparatus illustrated in FIGS. 3 and 3*a* will now be described, with particular reference being made to FIG. 11, in which the large boxes represent the various elements of the apparatus and the broad arrows indicate the flow of fibrous material through the apparatus, and in which the small boxes and line arrows represent control elements and functions.

In accordance with the operation of the controls, the sensing of a predetermined high level of fibrous material in the first hopper 51 by the high level sensing element 71 stops the operation of the tow cutting device so that no further tow is delivered to the hopper, thereby avoiding overfilling the hopper. As illustrated, sensing element 71 is a photoelectric cell which is positioned in the upper portion of hopper 51 and which cooperates with a lamp 71*a* on the opposite side of the hopper to generate a signal when the light beam from lamp 71*a* is uninterrupted. When the light beam is interrupted, as when the level of fibrous material in the hopper reaches or exceeds the desired predetermined level, the signal from sensing element 71 ceases and a motor control 74 stops motor *M* of the tow cutter. While not shown in detail, motor control 74 obviously includes a relay or other suitable means which is responsive to the signal from sensing element 71 for controlling the source of power to motor *M* of the tow cutter. When the level of fibrous material again drops below the desired level, as sensed by sensing element 71, the operation of the tow cutter will be resumed until once again the level of fibrous material in the hopper reaches the desired predetermined level. Preferably, the tow cutter is adjusted so as to deliver the fibrous material to the hopper at a rate exceeding the demand of the picker, so that the tow cutter will be cycled off and on in response to the variations in the level of the fibrous material in the hopper. However, if desired, the rate of delivery of the tow cutter may be coordinated with the demand of the picker so that the rate of cycling of the tow cutter is decreased or eliminated.

When the fibrous material in hopper 51 is almost exhausted, as sensed by low level sensing element 72, an alarm will be sounded to indicate to the operator or attendant that a low level of fibrous material exists on hopper 51 and that the tow cutter has apparently malfunctioned or run out of tow. As illustrated, low level sensing element 72 is a photoelectric cell and is positioned near the bottom of the hopper and cooperates with a suitable lamp 72*a* on the opposite side of the hopper to generate a signal when the level of fibrous material in the hopper drops below the level of the sensing element. Sensing element 72 is operatively connected to a suitable alarm and timer control 75 is adapted to sound an audible and/or visual alarm upon receiving a signal from sensing element 72. The signal from sensing element 72 also operates a timer which is adapted to stop the operation of the picker, through motor control 76, after a predetermined length of time if the feed of fibrous material to the hopper is not re-established within such time. This device insures that the picker will not operate with an insufficient level of fibrous material in the second feed hopper 52 and thereby avoids obtaining nonuniform delivery of fibrous material from the picker.

Sensing element 73, located in the second hopper 52, operates in a manner similar to sensing element 71 in the first hopper 51 to control the feed of fibrous material from the first hopper to the second hopper and to thereby maintain the level of the fibrous material in the second hopper 52 substantially uniform. As illustrated, sensing element 73 is a photoelectric cell and operates, together with a cooperating lamp 73*a*, and motor control 77 to stop the motor *M* of the first hopper 51 when a predetermined high level of fibrous material is present in the second hopper 52. Motor *M* of hopper 51 drives the previously described aprons and rolls which serve to feed the fibrous material from the first hopper 51 to the second hopper 52.

Referring now to the second form of the invention, it will be recalled from earlier descriptions that the apparatus employed in accordance with the second form of the invention is similar to that described with reference to the first form of the invention and illustrated in FIGS. 3 and 3*a* except that two pickers are provided instead of a single picker and means are provided for feeding the fibrous material from the tow cutter to the hoppers of both pickers as the respective pickers require additional fibrous material. Accordingly, only those parts of the apparatus which differ from that previously described will now be described, it being understood that the operation of the tow cutter, the pneumatic conveyor, and the operation of each of the pickers is essentially as previously described with reference to FIGS. 3 and 3*a*.

Referring to FIG. 5, reference character 80 broadly indicates part of an apparatus for feeding the fibrous material from the tow cutter to a pair of pickers. This feeding apparatus 80 also includes a pneumatic conveyor system of the type previously described including a material handling fan and conduits which receive the fibrous material from the tow cutter and convey the same to a condenser located adjacent the pickers. The condenser, indicated at 81 in FIG. 5, is of the type previously described, which receives the fibrous material pneumatically conveyed from the tow cutter and deposits the same in an elongate trough 82 positioned beneath condenser 81. The bottom of trough 82 consists of an endless apron or conveyor belt 83 which carries the fibrous material along the length of the condenser to the respective pickers, generally indicated at 90 and 91. As in the first form of the invention, pickers 90, 91 are each provided with a first feed hopper 92, 93 for receiving the fibrous material from feeding apparatus 80, and with a second feed hopper 94, 95, for receiving the fibrous material from the respective first hoppers 92, 93. At the first hopper 92 of the first picker 90, a portion of the side wall of trough 82 is removed while the opposite side wall is hinged to form a gate 85 adapted to swing across the trough and divert the fibrous material into hopper 92 of the first picker 90. A pneumatic cylinder 86, under the control of a control mechanism to be described later, operates gate 85 to divert fibrous material into hopper 92 as required. The fibrous material not diverted into hopper 92 of the first picker 90 travels along the length of trough 82 and is directed by deflecting plate 87 into the first hopper 93 of the second picker 91.

The control system for controlling operation of the apparatus in accordance with the second form of the invention will now be described with reference to FIG. 12. It will be noted that the low level sensing elements 96, 97 in the respective first hoppers 92, 93 of each of the pickers and the alarm and timer controls associated therewith operate in the same manner as has been previously described with reference to FIG. 11. Similarly, the high level sensing elements 98, 99 in the respective second hoppers 94, 95 of each of the pickers and the motor control means associated therewith also operate in the manner previously described to control the feeding of fibrous material from the first hopper to the second hopper of the respective pickers. Accordingly, a detailed explanation of these control elements and their functions will not be repeated.

Referring now to the first hopper 92 of the first picker 90, it will be noted that the high level sensing element (labeled 88 in FIG. 12) in this hopper is operatively connected through suitable electric controls to a valve *V* controlling the supply of air or other compressed fluid to a one-way pneumatic cylinder 86. Pneumatic cylinder 86 is operatively connected to gate 85 and is normally in the position shown so as to divert the fibrous material from the tow cutter into the hopper 92 of the first picker. When the desired predetermined level of fibrous material is present in hopper 92, sensing element 88 senses this condition and the electric controls operate valve *V* thereby causing gate 85 to be opened. Thus, the fibrous material is allowed to by-pass hopper 92 of the first picker and to be fed to the first hopper 93 of the second picker.

Upon the sensing of a predetermined high level of fibrous material in hopper 93 by the high level sensing element 89, a suitable electric motor control stops the operation of the motor *M* driving the tow cutter so that no further tow is delivered to the pickers. When the level of fibrous material in hopper 93 again drops below the desired predetermined level, as sensed by sensing element 89, the operation of the tow cutter will be resumed and fibrous material will again be fed to either the first picker 90 or the second picker 91 as required. As in the previous form of the invention, the tow cutter may be adjusted so as to deliver fibrous material to the pickers at a rate exceeding the total demand of the two pickers, in which case the tow cutter will be cycled off and on in response to the demands of hopper 93 in the second picker for additional fibrous material. If desired, the rate of delivery of the tow cutter may be coordinated with the total demand of the pickers so that the cycling of the tow cutter is decreased or eliminated.

In accordance with the above arrangement, the demands of the first picker 90 for fibrous material are satisfied first and the tow cutter is stopped only when the respective first hoppers 92, 93 of both pickers are filled to the desired level. This assures that both pickers will be provided with an adequate supply of fibrous material.

As illustrated in block form in FIG. 6, the third form of the invention is quite similar to the first form of the invention previously described, except that instead of forming the fibrous material into laps at the delivery end of the picker, the calender section of the picker is removed and the fibrous material is received at the delivery end of the picker and fed as a stream of loose fibers directly to a bank of cards, with each card being provided with means such as a conventional chute feed or hopper feed for receiving the loose fibers and for directing the same into the card, with such means hereinafter being generically referred to as transitory storage means.

Referring now to FIG. 8 which illustrates an apparatus in accordance with this third form of the invention, it will be noted that many of the elements thereof correspond to elements previously described with reference to the first form of the invention illustrated in FIGS. 3 and 3*a*. Accordingly, to avoid unnecessary repetition in description, those elements shown in FIG. 8 which correspond to similar elements shown in FIGS. 3 and 3*a* will bear the same reference characters, with prime notation added, where applicable.

It will be noted from viewing FIGS. 8 and 9 that the calender section of the picker has been removed and that means have been provided for receiving the fibrous material as it is delivered from the second beater section 54′ of the picker and for feeding the same to a bank of cards, generally indicated at 120. A duct 101 is positioned across the outlet side of the condenser screens 54*a* (FIG. 9) of the second beater section 54′ for receiving the fibrous material delivered from the picker. Although the fibrous material could be suitably taken from the picker as it leaves the beaters and without condensing at the condenser screens 54*a*, the expense involved in adapting the picker by removing the condenser screens makes this alternative unattractive for most installations. Duct 101 is connected to the inlet side of a material handling fan 102 so that the fibrous material being delivered from the picker is pneumatically collected or removed therefrom and pneumatically conveyed through a conduit 103 to a condenser 104 located adjacent a bank of cards 120. Condenser 104 is of the stationary screen type previously described and has associated therewith a suction fan 105 for removing the air supplied to condenser 104 by material handling fan 102.

The control system for controlling operation of the tow cutter and the picker in this third form of the invention is essentially the same as has been previously described with reference to FIG. 11, and accordingly will not be described in detail. However, in addition, motor control 76 of FIG. 11 is preferably also operatively connected to each card 121 in the bank of cards 120 as shown in FIG. 13. Thus, when the fibrous material in the first hopper 51′ of picker 50′ reaches a low level, the operation of not only picker 50′ but also the entire bank of cards 120 will be stopped to thereby avoid obtaining a nonuniform delivery of the fibrous material from the picker and the bank of cards.

The bank of cards 120 preferably includes from about eight to ten individual cards 121 arranged in any desired relation, but preferably in side-by-side relation as illustrated, and with each card being provided in a conventional manner with transitory storage means such as a chute 122 for receiving the fibrous material from the picker and directing or feeding the same into the card.

An elongate trough 106 extends the length of the bank of cards and is operatively connected with the chute 122 of each card. Condenser 104 is positioned at one end of the elongate trough 106 for delivering the fibrous material into the trough as it is received from picker 50'. The bottom of trough 106 consists of an endless apron or conveyor belt 107 which carries the fibrous material along the length of the trough from the condenser to the respective chutes 122 of each card in the bank of cards 120. At each chute 122, a portion of the side wall of trough 106 is removed while the opposite side wall of the trough is hinged to form a gate 108 adapted to swing across the trough and divert the fibrous material into the corresponding chute. Each gate 108 is operated by a pneumatic cylinder 109 located adjacent the gate.

The control system for controlling the feeding of the fibrous material into the various cards is illustrated in FIG. 13, where the broad arrow indicates the path of the fibrous material from the picker to the chutes 122 of the respective cards 121. Each chute 122 is provided with a sensing element 110 for sensing when a predetermined high level of fibrous material is present in the chute. As illustrated in FIG. 13, the sensing element 110 is a photoelectric cell and is mounted on one side of chute 122. A cooperating lamp 111 is mounted on the opposite side of the chute and projects a beam of light across the chute to the photoelectric cell.

Each gate 108 is operated by a one-way pneumatic cylinder 109 so as to close gate 108 and divert fibrous material into the chute when pressurized air is supplied to the cylinder, and to swing open and allow the fibrous material to by-pass the chute when the cylinder is not pressurized.

When the beam of light from lamp 111 strikes sensing element 110, indicating that the level of fibrous material in the chute is low, a conventional electric control circuit associated with the sensing element causes a valve *V* to open and to supply pressurized air to pneumatic cylinder 109. Gate 108 is thereby closed and fibrous material is diverted into the chute.

Referring now to the left hand card 121 illustrated in FIG. 13, the dashed lines in chute 122 indicate that the level of the fibrous material in the chute is sufficient and that the beam of light from lamp 111 is obstructed thereby. Thus, gate 108 remains open and allows the fibrous material to by-pass this chute. Referring to the middle card 121 illustrated in FIG. 13, the dashed lines in chute 122 of this card indicate that the fibrous material in this chute is at a level below the sensing element 110. The beam of light from lamp 111 strikes the sensing element 110 and causes gate 108 to be closed, thereby diverting fibrous material into the chute. The gate will remain in this position until the level of fibrous material in the chute is raised sufficiently to interrupt the beam of light, at which time the gate 108 will open and allow the fibrous material to by-pass this card. The dashed lines in chute 122 of the right hand card of FIG. 13 indicates that the level of fibrous material present in this chute is also low. However, since a gate 108 upstream from this card is closed, this card will receive no fibrous material until all of the upstream chutes are filled with fibrous material and their respective gates 108 are opened. The output of picker 50 is preferably adjusted in accordance with the total demand of the bank of cards so that all of the cards in the bank are always fed a sufficient supply of fibrous material and there is no substantial excess of fibrous material being processed by the picker. In this regard, the evener motion of picker is particularly desirable for facilitating coordinating the output of the picker with the total demand of the bank of cards.

As illustrated in block form in FIG. 7, the fourth form of the invention is similar to the third form of the invention illustrated in FIG. 6, except that the fibrous material, instead of being fed from the tow cutter to a single picker, is fed to a plurality of pickers. This arrangement is necessary when the bank of cards has a total rate of production in excess of that capable of being supplied by single picker.

Referring to FIG. 10, it will be noted that the apparatus in accordance with this fourth form of the invention is similar to that previously described with reference to FIG. 8 except that two pickers are provided and means are provided for feeding the fibrous material from the tow cutter to the hoppers of both pickers. Accordingly, to avoid repetitive description, those elements shown in FIG. 10 which correspond to elements previously shown and described with reference to FIG. 8 will bear the same reference characters, with prime notation added, where applicable.

Referring to the two pickers shown in FIG. 10, broadly indicated at 131 and 132, and to the apparatus, broadly designated at 133, for feeding the fibrous material from the tow cutter to the hoppers of the respective pickers 131 and 132, it will be readily apparent that a similar arrangement of apparatus has been described in detail with respect to an earlier form of the invention, as illustrated in FIG. 5. Accordingly, a detailed description of this apparatus and its method of operation will not be repeated. It is believed sufficient to merely point out that the feeding apparatus 133, like the feeding apparatus 80 shown in FIG. 5, includes a pneumatic conveyor for conveying the fibrous material from the tow cutter 32'', a condenser 134 for receiving the fibrous material as it is pneumatically conveyed from the tow cutter 32'' and a trough 135 positioned for receiving the fibrous material from condenser 134 and for controllably directing the fibrous material into the first feed hopper of pickers 131 and 132 as required. It will also be noted that the calender section has been removed from each of these pickers and that a duct 101' has been positioned in front of the outlet side of the condenser screens of the second beater section of each picker for receiving the fibrous material delivered therefrom. Conduits 136 and 137 interconnect the respective ducts 101' with the inlet side of the material handling fan 102'. The controls for controlling the feed of fibrous material into the hoppers of the respective pickers 131, 132 and the controls for controlling the feed of fibrous material into the respective chutes 122' of the bank of cards are essentially the same as that previously described with reference to FIGS. 12 and 13. Additionally, in order to avoid obtaining a nonuniform delivery of fibrous material from the pickers and from the bank of cards, the control system is adapted to stop operation of both of the pickers 131 and 132 and also the bank of cards 120' (FIG. 10) when the fibrous material in the first hopper of either picker 131 or picker 132 falls below a predetermined low level. It will be readily apparent that the motor controls associated with the respective low level sensing elements 96, 97 may be operatively connected to the other picker and to the bank of cards to accomplish this function.

The present invention is particularly adapted for forming uniform blends of different types of fibers at an early stage in the processing thereof rather than at the draw frame as is conventional. In combining the several tows $T$ into a single composite tow $T'$ prior to cutting, one or more of the tows may be formed of continuous filaments of a different characteristic from the continuous filaments of another of the tows. Blends may be produced in this manner wherein the filaments of the various tows are of different composition, or wherein the filaments are of different texture, crimp, inherent crimpability, or other characteristic.

In the drawings and specification, there have been set forth preferred embodiments of the invention, and although specific terms are employed, they are used in a generic and descriptive sense only and not for purposes of limitations.

That which is claimed is:

1. Apparatus for processing preformed continuous filament tow positioned in a container comprising a tow cutter for receiving the continuous filament tow from the container and for severing the same into fibrous material of predetermined staple length, and means positioned ahead of said tow cutter for guiding the preformed continuous filament tow from the container to said tow cutter and for aiding in the removal of any folds or entanglements present in the tow upon its removal from the container, a picker having a hopper for receiving the fibrous material from said tow cutter and also having evening means for obtaining a substantially uniform weight of delivery of the fibrous material processed therethrough, means operatively connected to said tow cutter and to the hopper of said picker for feeding the fibrous material from said tow cutter to said picker, and wherein said hopper is provided with means for stopping operation of said tow cutter in response to a predetermined high level of fibrous material being present in said hopper to thereby avoid overfilling said hopper.

2. Apparatus according to claim 1 wherein said picker is provided with lap forming means at its delivery end for forming laps for subsequently being processed through cards.

3. Apparatus according to claim 1, wherein a bank of cards is operatively connected to said picker with each card having transitory storage means for receiving the fibrous material from said picker and for directing the same into the card, and means are provided for receiving the fibrous material at the delivery end of the picker and for feeding the same to the respective transitory storage means of said bank of cards.

4. Apparatus according to claim 1, wherein said hopper is provided with means for stopping operation of said picker in response to the fibrous material being substantially exhausted from said hopper to thereby avoid obtaining nonuniform delivery of fibrous material from said picker.

5. Apparatus according to claim 1, wherein said picker is provided with a second hopper positioned adjacent said first recited hopper for receiving the fibrous material therefrom, and wherein said first recited hopper includes means for feeding the fibrous material from the first recited hopper to said second hopper.

6. Apparatus according to claim 5, additionally including means for stopping the feeding of fibrous material from the first hopper to said second hopper of said picker in response to a predetermined high level of fibrous material being present in said second hopper to thereby facilitate obtaining a more uniform weight of delivery of fibrous material from said picker.

7. Apparatus according to claim 6 wherein said first hopper of said picker is provided with means for stopping operation of said picker in response to the fibrous material being substantially exhausted from said first hopper to thereby avoid obtaining nonuniform delivery of fibrous material from said picker.

8. Apparatus according to claim 1, additionally comprising a second picker positioned adjacent said first recited picker, said second picker also having a hopper for receiving the fibrous material from said tow cutter and having evening means for obtaining a substantially uniform weight of delivery of fibrous material processed therethrough, and wherein said means for feeding the fibrous material from said tow cutter to said first recited picker is operatively connected to the hopper of said second picker for also feeding the fibrous material to said second picker.

9. Apparatus according to claim 1 wherein said means for feeding the fibrous material from said tow cutter to said picker includes pneumatic conveyor means.

10. Appparatus for processing continuous filament tow comprising a tow cutter for receiving continuous filament tow and for serving the same into fibrous material of predetermined staple length, a picker associated with said tow cutter and including first and second hoppers for receiving the fibrous material from said tow cutter, means operatively connected to said tow cutter and to the first hopper of said picker for feeding the fibrous material from said tow cutter to said picker, said first hopper of said picker including means for stopping operation of the tow cutter in response to a predetermined high level of fibrous material being present in said first hopper and also including means for feeding the fibrous material forwardly therefrom, said second hopper being positioned forwardly of said first hopper for receiving the fibrous material from said first hopper and including means for stopping the feeding of fibrous material from said first hopper to said second hopper in response to a predetermined high level of fibrous material being present in said second hopper to facilitate obtaining a more uniform weight of delivery of fibrous material from said picker, a bank of cards operatively connected to said picker with each card having transitory storage means for receiving the fibrous material from said picker and for directing the same into the card, and means for receiving the fibrous material at the delivery end of the picker and for feeding the same to the respective transitory storage means of said bank of cards.

11. Apparatus according to claim 10 wherein said first hopper of said picker is also provided with means for stopping operation of said picker and said bank of cards in response to the fibrous material being substantially exhausted from said first hopper to thereby avoid obtaining nonuniform delivery of fibrous material from said picker and bank of cards.

12. Apparatus for processing preformed continuous filament tow positioned in a container comprising a tow cutter for receiving the continuous filament tow from the container and for severing the same into fibrous material of predetermined staple length, and means positioned ahead of said tow cutter for guiding the preformed continuous filament tow from the container to said tow cutter and for aiding in the removal of any folds or entanglements present in the tow upon its removal from the container, a plurality of pickers associated with said tow cutter with each of said pickers having a hopper for receiving the fibrous material from said tow cutter and having evening means for obtaining a substantially uniform weight of delivery of fibrous material processed therethrough, and with each of said pickers also being provided with lap forming means at the delivery end thereof for forming the fibrous material into laps for being subsequently processed through cards, means operatively connected to said tow cutter and to the respective hoppers of each of said pickers for feeding the fibrous material from said tow cutter to each of said pickers and wherein the respective hoppers of the pickers are provided with means for stopping operation of said tow cutter in response to a predetermined high level of fibrous material being present in said hoppers to thereby avoid overfilling the hoppers.

13. Apparatus for processing continuous filament tow comprising a tow cutter for receiving continuous filament tow and for severing the same into fibrous material of predetermined staple length, a plurality of pickers associated with said tow cutter with each of said pickers having a hopper for receiving the fibrous material from said tow cutter and having evening means for obtaining a substantially uniform weight of delivery of fibrous material processed therethrough, means operatively connected to said tow cutter and to the respective hoppers of each of said pickers for feeding the fibrous material from said tow cutter to each of said pickers, a bank of cards operatively connected to said pickers with each card having transitory storage means for receiving the fibrous material from said pickers and for directing the same into the card, and means for receiving the fibrous material at the delivery end of said pickers and for feeding the same to the respective transitory storage means of said bank of cards.

14. Apparatus according to claim 13 wherein each of said pickers is provided with a second hopper positioned adjacent said first recited hopper for receiving the fibrous material therefrom, and wherein said first recited hopper includes means for feeding the fibrous material from the first recited hopper to said second hopper.

15. Apparatus according to claim 14 additionally including means associated with each of said pickers for stopping the feeding of fibrous material from the first hopper to said second hopper of the picker in response to a predetermined high level of fibrous material being present in said second hopper to facilitate obtaining a more uniform weight of delivery of fibrous material from said pickers.

16. A method of processing preformed continuous filament tow comprising guiding the preformed tow from a supply container through a predetermined path of travel to a tow cutter while removing any folds or entanglements present in the tow and while severing the tow into fibrous material of predetermined staple length and while feeding the fibrous material as it is delivered from the tow cutter to a hopper of a picker and through the picker to obtain a substantially uniform weight of fibrous material therefrom, and stopping operation of the tow cutter in response to a predetermined high level of fibrous material being present in the hopper.

17. A method according to claim 16 comprising forming the fibrous material into laps at the delivery end of the picker for being subsequently processed through cards.

18. A method according to claim 16 comprising feeding the fibrous material as a stream of loose fibers from the delivery end of the picker to a bank of cards for forming carded stock therefrom.

19. A method according to claim 16 including stopping operation of the picker in response to the fibrous material being substantially exhausted from the hopper of the picker.

20. A method according to claim 16 comprising pneumatically collecting the fibrous material as it is delivered from the picker and pneumatically feeding the fibrous material in loose fibrous form to a bank of cards for forming carded stock therefrom.

21. A method according to claim 16 wherein the continuous filament tow fed to the tow cutter comprises a plurality of tows and wherein at least one of the tows is formed of continuous filaments of a different characteristic from the continuous filaments of another one of the tows to thereby facilitate obtaining a blend of fibrous material from different types of tow.

* * * * *

UNITED STATES PATENT AND TRADEMARK OFFICE

CERTIFICATE OF CORRECTION

PATENT NO. : 3,930,285

DATED : January 6, 1976

INVENTOR(S) : William D. Wornall

It is certified that error appears in the above-identified patent and that said Letters Patent are hereby corrected as shown below:

Please change the Assignees in the above patent as follows:

-- Alfred Proctor Aldrich, Jr., Atlanta, Ga.; Aldrich Machine Works, Greenwood, S. C.; Lummus Industries, Inc., Columbus, Ga. --

Signed and Sealed this

*fourth* Day of *May 1976*

[SEAL]

*Attest:*

RUTH C. MASON
*Attesting Officer*

C. MARSHALL DANN
*Commissioner of Patents and Trademarks*